US008857090B2

(12) United States Patent
Aigner

(10) Patent No.: US 8,857,090 B2
(45) Date of Patent: Oct. 14, 2014

(54) FIRING MECHANISM FOR A FIREARM

(75) Inventor: Friedrich Aigner, St. Valentin (AT)

(73) Assignee: Steyr Mannlicher GmbH, Kleinraming (AT)

( * ) Notice: Subject to any disclaimer, the term of this patent is extended or adjusted under 35 U.S.C. 154(b) by 0 days.

(21) Appl. No.: 13/822,715

(22) PCT Filed: Jul. 19, 2011

(86) PCT No.: PCT/AT2011/000306

§ 371 (c)(1),
(2), (4) Date: Mar. 13, 2013

(87) PCT Pub. No.: WO2012/037583

PCT Pub. Date: Mar. 29, 2012

(65) Prior Publication Data

US 2013/0174460 A1 Jul. 11, 2013

(30) Foreign Application Priority Data

Sep. 24, 2010 (AT) ..... A 1596/2010

(51) Int. Cl.

| | |
|---|---|
| ***F41A 19/00*** | (2006.01) |
| ***F41A 19/31*** | (2006.01) |
| ***F41A 19/13*** | (2006.01) |
| ***F41A 19/12*** | (2006.01) |
| ***F41A 19/06*** | (2006.01) |

(52) U.S. Cl.

CPC ..... *F41A 19/06* (2013.01); *F41A 19/31* (2013.01); *F41A 19/13* (2013.01); *F41A 19/12* (2013.01)

USPC ..... 42/69.01; 42/69.02; 42/70.08

(58) Field of Classification Search

USPC ..... 42/69.01, 69.02, 70.08

See application file for complete search history.

(56) References Cited

U.S. PATENT DOCUMENTS

| | | | |
|---|---|---|---|
| 2,348,790 | A | 5/1944 | de Kiraly et al. |
| 4,126,079 | A | 11/1978 | Perrine |
| 4,704,945 | A | 11/1987 | Marcon et al. |
| 4,977,815 | A | 12/1990 | Stephens |
| 5,024,139 | A | 6/1991 | Knight, Jr. et al. |

(Continued)

FOREIGN PATENT DOCUMENTS

| | | | |
|---|---|---|---|
| DE | 740175 | | 10/1943 |
| DE | 4125148 | A1 | 2/1993 |
| EP | 0207827 | A1 | 5/1986 |
| WO | WO 2009065161 | A1 | 5/2009 |

OTHER PUBLICATIONS

International Preliminary Report on Patentability for PCT/AT2011/000306 dated Apr. 4, 2013.

Austrian Office Action dated Jun. 8, 2011.

(Continued)

*Primary Examiner* — Michelle R Clement

(74) *Attorney, Agent, or Firm* — Hoffmann & Baron, LLP

(57) ABSTRACT

The invention relates to a firing mechanism for a firearm, comprising a housing in which a spring-loaded firing pin is guided in a guide, which firing pin can be held in a cocked position by means of a firing pin lug which latches on a latching tab of a latching piece and lies radially on one side of the firing pin, with the firing pin being guided in the guide via at least one roller, and wherein the roller lies on that side of the firing pin that is located radially opposite to the firing pin lug.

18 Claims, 3 Drawing Sheets

(56) References Cited

U.S. PATENT DOCUMENTS

| | | | | |
|---|---|---|---|---|
| 5,386,659 | A * | 2/1995 | Vaid et al. | 42/69.02 |
| 6,634,129 | B1 | 10/2003 | Freeman, Jr. | |
| 7,213,359 | B2 * | 5/2007 | Beretta | 42/70.08 |
| 8,132,496 | B2 * | 3/2012 | Zukowski | 89/142 |
| 2010/0170131 | A1 * | 7/2010 | Zukowski | 42/70.08 |
| 2010/0170138 | A1 * | 7/2010 | Zukowski | 42/148 |
| 2013/0074391 | A1 * | 3/2013 | Curry | 42/70.08 |
| 2013/0174460 | A1 * | 7/2013 | Aigner | 42/69.01 |

OTHER PUBLICATIONS

Written Opinion of ISA for International Application No. PCT/AT2011/000306 dated Jul. 19, 2011.

International Search Report for PCT/AT2011/000306 dated Mar. 29, 2012.

* cited by examiner

FIRING MECHANISM FOR A FIREARM

CROSS-REFERENCE TO RELATED APPLICATIONS

This application is a National Phase application of International Application No. PCT/AT2011/000306 filed Jul. 19, 2011 which claims priority to Austrian Patent Application No. A 1596/2010 filed Sep. 24, 2010, the disclosures of which are incorporated herein by reference.

The present invention relates to a firing mechanism for a firearm, comprising a housing in which a spring-loaded firing pin is guided in a guide, which firing pin can be held in a cocked position by means of a firing pin lug which latches on a latching tab of a latching piece, and lies radially on one side of the firing pin, wherein the firing pin is guided in the guide via at least one roller.

BACKGROUND

For the needs of snipers, hunters and the use in sport shooting, very often high-precision firearms are required which can be sensitively actuated by the shooter so that the shooting accuracy is not affected. For this, it is desirable to reduce the trigger weight of the firearm so that the shooter, when actuating the trigger, can fire the shot using low force.

In order to meet the above-mentioned requirements, a firing mechanism of the aforementioned kind, which is used for semi-automatic pistols, has already been introduced in U.S. Pat. No. 5,024,139. In the case of said known firing mechanism, the firing pin carries a lateral firing pin lug in which a roller is mounted which rolls on a linear guide of the housing of the weapon so as to keep the firing pin lug in engagement with the latching piece of the trigger mechanism. The firing pin itself is guided with sliding friction in a conventional manner in a bore of the breech. Due to the asymmetric lateral arrangement of the firing pin lug, the firing pin can tilt with respect to the housing resulting in increased friction which, in turn, increases the trigger weight.

SUMMARY

It is an object of the invention to provide a firing mechanism for a firearm with reduced trigger weight.

This object is achieved with a firing mechanism of the aforementioned kind, which is characterized according to the invention in that the roller lies on the side of the firing pin radially opposite to the firing pin lug.

By means of the firing mechanism according to the invention, the firing pin is supported in its guide by a roller radially resting against the firing pin, which roller is arranged diametrically opposite to the firing pin lug and the latching piece resting thereon, by which means the radial force component applied by the latching piece onto the firing pin via the firing pin lug is compensated. This prevents the firing pin from tilting in its guide, and the friction occurring between the firing pin and the housing is considerably minimized which, in turn, reduces the trigger weight significantly. Consequently, the operating-related wear of the entire firing mechanism is reduced, whereby safety with respect to malfunctions can be ensured in the long term. Moreover, the reduction of the occurring forces and frictions in the firing mechanism enables also a uniform, approximately linear trigger characteristic of the firearm.

It is principally possible to mount the roller directly on the firing pin. However, particularly preferred, the roller is rotatably mounted on the housing, which makes a separate guide for the sliding of the roller in the housing redundant.

According to a further preferred feature of the invention, precisely one roller is located diametrically opposite to the firing pin lug, whereby a very compact construction of the firearm can be achieved.

According to an alternative preferred embodiment of the invention, two rollers are located symmetrically and with obliquely extending rotational axes opposite to the firing pin lug. Thereby, the friction forces acting against the movement of the firing pin can be further reduced. Moreover, by using obliquely positioned rollers, the overall height of the weapon can be reduced, which reduces the leverage of the recoil and thus increases the shooting accuracy. Preferably, the rotational axes of the two rollers run perpendicular to each other. In this manner, the firing pin can be mounted in a particularly stable manner.

Using two symmetrically and obliquely positioned rollers opens also the possibility that advantageously, a signal pin actuatable by an inserted round extends through the two rollers so that said signal pin can be visibly presented via a sight opening on the backside of the housing of the weapon. As a result, the shooter can clearly see whether the weapon is loaded or not.

According to a further preferred feature of the invention, at least one further roller is arranged between the firing pin lug of the firing pin and the latching tab of the latching piece. Thereby, friction and wear on the firing pin lug and the latching tab and consequently the trigger weight can be further minimized. In this context it should be noted that a roller arranged on the latching tab of a latching piece is known per se from the document DE 41 25 148 A1.

It is particularly advantageous here if the mentioned further roller is rotatably mounted on the firing pin lug so as to keep the movable mass low.

Furthermore, it is particularly advantageous if the latching tab of the latching piece is formed to be wedge-shaped and interacts with a complementarily chamfered firing pin lug. As a result, the firing pin lug can slide over the latching tab during the actuation of the firing mechanism, which gives the shooter an excellent control over the trigger process.

Preferably, the latching piece has a bearing pin that is movable between two positions within an oblong hole arranged in the housing, wherein the latching piece rests in the one position on a latching pin fixed to the housing and retains the firing pin lug in this manner, and in the other position, is disengaged from the latching pin and releases the firing pin lug for firing the firing pin. Thus, unintended releasing of the firing pin, e.g., due to an impact or a fall, can be ruled out.

BRIEF DESCRIPTION OF THE DRAWINGS

The invention is explained hereinafter in more detail by means of exemplary embodiments illustrated in the accompanying drawings. In the figures.

DETAILED DESCRIPTION

Figure 1:
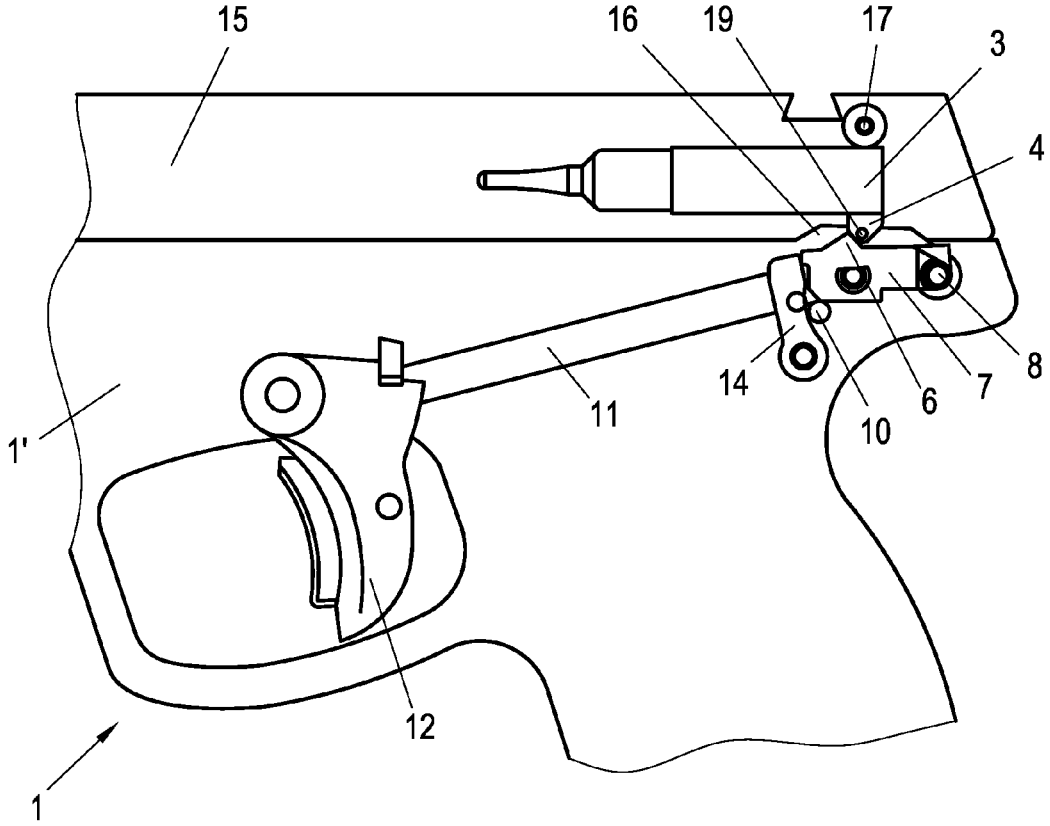
FIG. 1 shows a first embodiment of the firing mechanism according to the invention based on a partial schematic axial section of a firearm.
Figure 2:
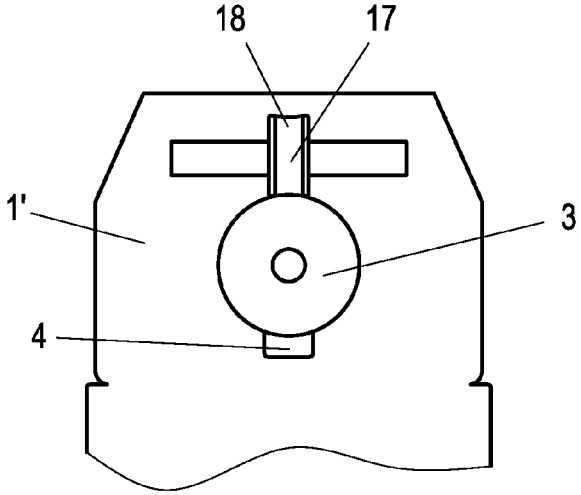
FIG. 2 shows a schematic radial section through the firing pin guide portion of the firearm of FIG. 1.
Figure 3A:
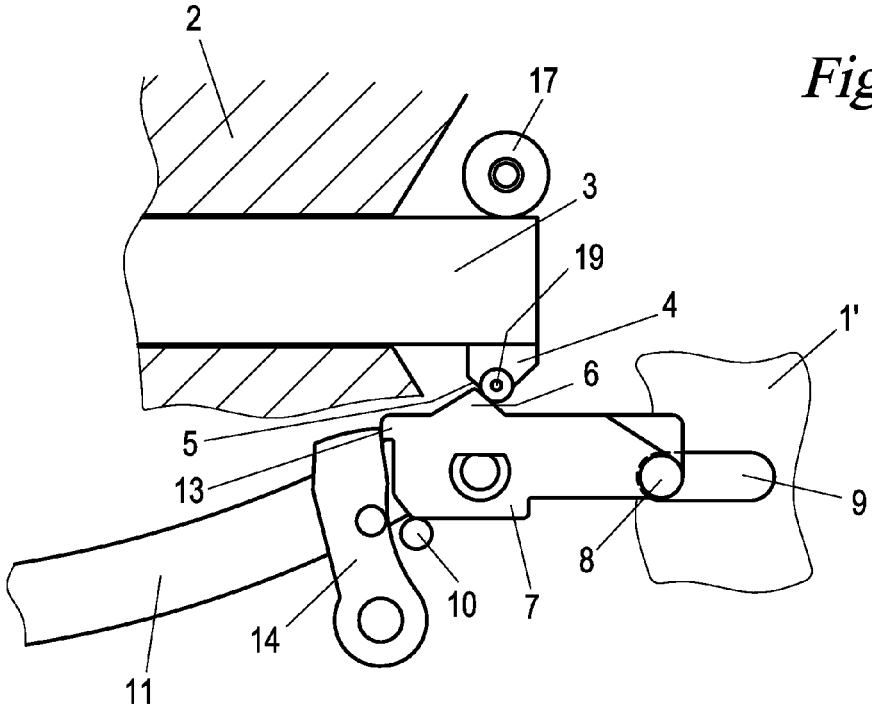
FIGS. 3*a* and 3*b* show in each case a schematic side view of the firing mechanism of FIG. 1 in two different operating positions.

In the FIGS. 1 to 3, details of a pistol 1 with a housing 1' are shown, namely that part of the pistol 1 that comprises the basic components of the trigger and firing mechanism thereof. The remaining components of the pistol 1 such as the barrel with chamber, breech, magazine, etc., which are of the conventional type, are not shown for the purpose of clarity of the illustration. It is to be understood that the field of use of the firing mechanism described in detail hereinafter is not limited to pistols, but extends to hunting rifles, sporting weapons, submachine guns and the like.

The firing mechanism illustrated in the FIGS. 1 to 3 comprises a firing pin 3 that axially slides in a guide 2 of the housing 1'. A firing pin spring (not shown) acts in the direction to the cartridge chamber of the pistol (in the drawings to the left) on the firing pin 3. The firing pin 3 has a firing pin lug 4 which protrudes radially downward and, when the firing mechanism is cocked, is retained at a chamfer 5 by a wedge-shaped latching tab 6 of a movably mounted latching piece 7, which latching tab is formed complementarily to said chamfer.

Figure 3B:
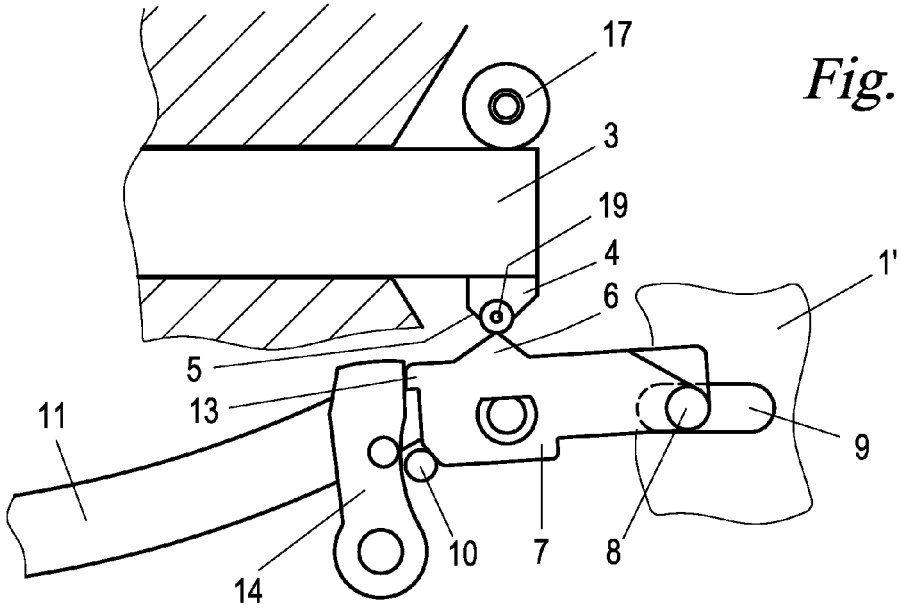

The latching piece 7 has a bearing pin 8 which is movable and rotatably mounted within an oblong hole 9 formed in the housing 1'. Thus, the latching piece 7 can be shifted between two positions, namely a first ready-to-fire position or cocked position (FIG. 3) in which the front part of the latching piece 7 rests on the latching pin 10 fixed to the housing so as to latch the firing pin lug 4 at the latching tab, and a second shot-discharging position or firing position in which the latching piece is moved backward and is pivoted downward past the latching pin 10 so as to release the firing pin 3 for firing. FIG. 3*b* shows the latching piece 7 in an intermediate position on the way to its firing position. Of course, it is also possible in this connection that the bearing pin 8 is fixed to the housing and the oblong hole 9 is formed in the latching piece 7. A trigger bar 11 serves for actuating the latching piece 7, which trigger bar transmits the movement of a trigger blade 12 to the latching piece 7.

When firing the shot, a housing slide 15 with the breech (not shown) and the firing pin 3 is pushed backward by the occurring recoil against the force of the firing pin spring so as to cock said spring again. During the backward movement of the slide 15, the latching piece 7 pivots upward again driven by the spring so as to catch with the latching tab 6 the firing pin 3 which moves forward together with the slide 15.

A lifter 14 that is mounted upstream of the latching piece 7 and is spring-loaded against the latter engages during the forward movement of the latching piece 7 below a front nose 13 of the latter in order to lift the latching piece 7 above the latching pin 10. At the end of the forward movement of the latching piece 7, the latter has pivoted the lifter 14 forward again, namely so far that the nose 13 is disengaged from the lifter and the latching piece falls back onto the latching pin 10 into is initial or cocked position shown in FIG. 3*a*. The pistol 1 is now ready-to-fire again.

The preload force excerted by the lifter 14 onto the latching piece 7 supports the movement of the trigger bar 11 when actuating the trigger blade 14, which reduces the trigger weight.

The following measures serve for further reducing the trigger weight. For reducing the friction of the firing pin 3 in its guide 2, at least one roller 17 is arranged between the guide 2 and/or the housing 1' on the one side and the firing pin 3 on the other side. The roller 17 lies radially on the side or half of the firing pin 3 opposite to the firing pin lug 4 so as to absorb the radial force component excerted via the latching tab 6 and the firing pin lug 4 onto the firing pin 3, which otherwise would cause tilting (canting) or increased friction of the firing pin 3 in the guide 2. For this, the roller 17 preferably engages with the firing pin exactly diametrical to the firing pin lug 4, although this is not absolutely necessary in simplified embodiments.

Instead of a single roller, it is also possible that a plurality of rollers 17 are provided which, e.g., are successively arranged in the axial direction of the firing pin 2 and engage with the same and/or are arranged distributed over the circumference of the firing pin 3. An extension to so-called "roller carpets" or ball bearings for mounting the firing pin 3 is also possible.

Figure 4:
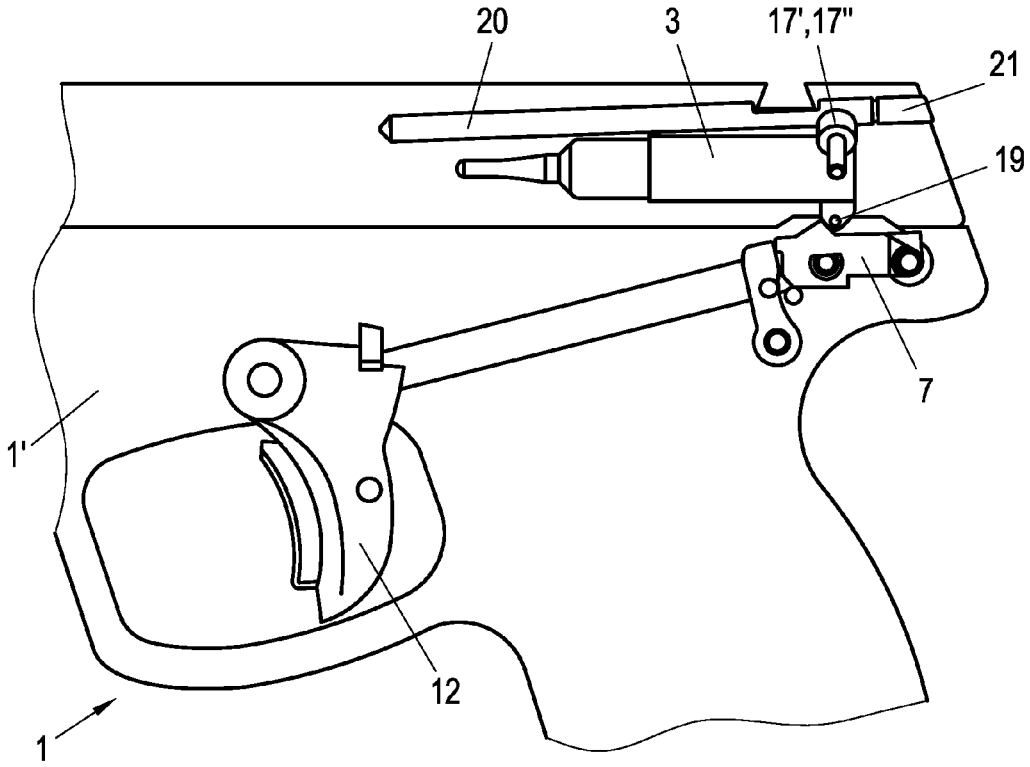
FIG. 4 shows a second embodiment of the firing mechanism according to the invention based on a partial schematic axial section of a firearm.
Figure 5:
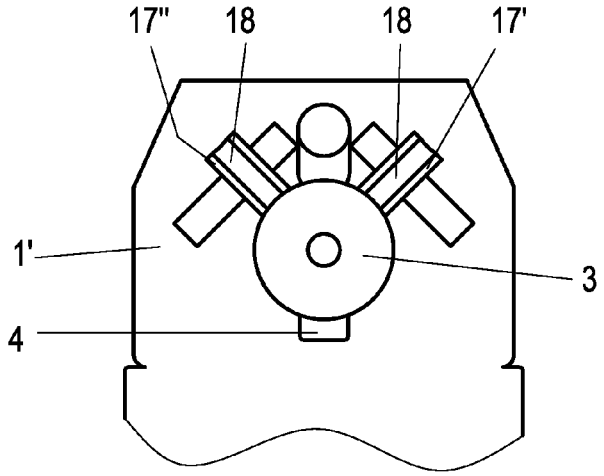
FIG. 5 shows a schematic radial section through the firing pin guide portion of the firearm of FIG. 4.

FIGS. 4 and 5 show such an alternative, particularly advantageous embodiment in which two of the rollers 17', 17" are active between the housing 1' or, respectively, the guide 2 and the firing pin 3. The rollers 17', 17" are arranged symmetrically and have obliquely running rotational axes, and are arranged opposite to the firing pin lug 4. The rotational axes of the rollers 17', 17" preferably run perpendicular to each other; however, other angles between their rotational axes are also conceivable, e.g., 30° or 60°.

In the exemplary embodiments shown, the rollers 17, 17', 17" are in each case rotatably mounted on the housing 1' or the guide 2 of the pistol. Alternatively, one, a plurality of, or all rollers can be mounted on the firing pin 3 itself, in particular on its side facing away from the firing pin lug 4, so as to absorb the radial forces thereof. For example, one roller 17 or two rollers 17', 17" can be rotatably mounted in a recess formed on the firing pin 3, or on bearing straps formed thereon, and roll on a linear guide of the housing 1' or the guide 2, by which means the same effect can be achieved.

The rollers 17, 17', 17" can be formed cylindrically or torically (in a row) or—in particular if they roll on the firing pin 3—can be formed with a groove 18 on their circumference. The use of twin rollers, triplet rollers, etc. is also possible.

For further reduction of the friction forces and thus the trigger weight on the trigger blade 12, optionally, one or a plurality of rollers can be configured to act between the latching tab 6 and the firing pin lug 4. In the example show, a roller 19 is rotatably mounted on the chamfer of the firing pin 4 exactly opposite to the latching tab 6. Alternatively, the roller 19 could also be rotatably mounted on the latching tab 6.

In order that the shooter can see whether the pistol 1 is ready to fire or not, a signal pin 20 can be provided which is spring-loaded and is pushed backward by a round inserted into the weapon so as to extend through a sight opening 21 of the housing 1'. In the embodiment of the FIGS. 4 and 5, the signal pin 20 can penetrate between the two rollers 17', 17" which rest obliquely against the firing pin 3, which saves installation space, in particular, overall height.

Accordingly, the invention is not limited to the illustrated embodiments but comprises all variants, combinations and modifications which fall within the scope of the enclosed claims.

What is claimed is:

1. A firing mechanism for a firearm, comprising a housing in which a spring-loaded firing pin is guided in a guide, wherein the firing pin can be held in a cocked, spring-loaded position by means of a firing pin lug which latches on a latching tab of a latching piece and lies radially on one side of the firing pin, with the firing pin being guided in the guide via at least one roller, being positioned on a side of the firing pin that is located substantially radially opposite to the firing pin lug; wherein at least one further roller is arranged between the firing pin lug of the firing pin and the latching tab of the latching piece.

2. The firing mechanism according to claim 1, wherein the at least one roller guiding the firing pin is rotatably mounted on the housing.

3. The firing mechanism according to claim 1, wherein a single roller which guides the firing pin lies diametrically opposite to the firing pin lug.

4. The firing mechanism according to claim 1, wherein two rollers are arranged symmetrically and with obliquely running rotational axes opposite to the firing pin lug.

5. The firing mechanism according to claim 4, wherein the rotational axes of the two rollers run perpendicular to each other.

6. The firing mechanism according to claim 4, wherein a signal pin that is movable against an impact base of a cartridge extends through the two rollers thereby being visible via a sight opening of the housing.

7. The firing mechanism according to claim 1, wherein the at least one further roller is rotatably mounted on the firing pin lug.

8. The firing mechanism according to claim 1, wherein the latching tab of the latching piece is formed in a wedge-shaped manner and interacts with a firing pin lug that is chamfered complementary thereto.

9. The firing mechanism according to claim 8, wherein the latching piece has a bearing pin that is movable between two positions within an oblong hole arranged in the housing, wherein the latching piece rests in the one position against a latching pin fixed to the housing and holds the firing pin lug in this manner, and, in the other position, is disengaged from the latching pin and releases the firing pin lug for firing the firing pin.

10. A firing mechanism for a firearm comprising:

a housing including a spring-loaded firing pin axially slideable within a guide in the housing;

the firing pin including a firing pin lug which protrudes radially outward from the firing pin and, when the firing mechanism is cocked, is retained by a latching tab on a latching piece wherein the latching tab of the latching piece is formed in a wedge-shaped manner and interacts with a firing pin lug that is chamfered complementary thereto; and at least one roller positioned between the housing guide and the firing pin to reduce friction of the firing pin moving within the housing guide, the at least one roller being further positioned radially on a half of the firing pin opposite the firing pin lug thereby reducing the radial force exerted on the firing pin via the engagement of the firing pin lug with the latching tab.

11. A firing mechanism according to claim 10, wherein the roller is positioned substantially diametrically opposite to the firing pin lug.

12. A firing mechanism according to claim 10, wherein two rollers are arranged symmetrically and with obliquely running rotational axes opposite the firing pin lug.

13. The firing mechanism according to claim 10, wherein the latching piece has a bearing pin that is movable between two positions within an oblong hole arranged in the housing, wherein the latching piece rests in the one position against a latching pin fixed to the housing and holds the firing pin lug in this manner, and, in the other position, is disengaged from the latching pin and releases the firing pin lug for firing the firing pin.

14. A firing mechanism for a firearm, comprising a housing in which a spring-loaded firing pin is guided in a guide, which firing pin can be held in a cocked position by means of a firing pin lug which latches on a latching tab of a latching piece and lies radially on one side of the firing pin, with the firing pin being guided in the guide via two rollers arranged symmetrically and with obliquely running rotational axes opposite to the firing pin lug.

15. A firing mechanism for a firearm, comprising a housing in which a spring-loaded firing pin is guided in a guide, wherein the firing pin can be held in a cocked, spring-loaded position by means of a firing pin lug which latches on a latching tab of a latching piece and lies radially on one side of the firing pin, with the firing pin being guided in the guide via at least one roller, being positioned on a side of the firing pin that is located substantially radially opposite to the firing pin lug, wherein the latching tab of the latching piece is formed in a wedge-shaped manner and interacts with a firing pin lug that is chamfered complementary thereto.

16. A firing mechanism for a firearm, comprising a housing in which a spring-loaded firing pin is guided in a guide, wherein the firing pin can be held in a cocked, spring-loaded position by means of a firing pin lug which latches on a latching tab of a latching piece and lies radially on one side of the firing pin, with the firing pin being guided in the guide via at least one roller, being positioned on a side of the firing pin that is located substantially radially opposite to the firing pin lug, wherein the latching piece has a bearing pin that is movable between two positions within an oblong hole arranged in the housing, wherein the latching piece rests in the one position against a latching pin fixed to the housing and holds the firing pin lug in this manner, and, in the other position, is disengaged from the latching pin and releases the firing pin lug for firing the firing pin.

17. The firing mechanism according to claim 14, wherein the rotational axes of the two rollers run perpendicular to each other.

18. The firing mechanism according to claim 14, wherein a signal pin that is movable against an impact base of a cartridge extends through the two rollers thereby being visible via a sight opening of the housing.

* * * * *